US011131081B2

(12) United States Patent
Kozui

(10) Patent No.: US 11,131,081 B2
(45) Date of Patent: Sep. 28, 2021

(54) PIVOTING WORK MACHINE

(71) Applicant: KOBELCO CONSTRUCTION MACHINERY CO., LTD., Hiroshima (JP)

(72) Inventor: Masatoshi Kozui, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 0 days.

(21) Appl. No.: 16/759,872

(22) PCT Filed: Oct. 12, 2018

(86) PCT No.: PCT/JP2018/038104
§ 371 (c)(1),
(2) Date: Apr. 28, 2020

(87) PCT Pub. No.: WO2019/093070
PCT Pub. Date: May 16, 2019

(65) Prior Publication Data

US 2020/0340211 A1 Oct. 29, 2020

(30) Foreign Application Priority Data

Nov. 8, 2017 (JP) ..... JP2017-215634

(51) Int. Cl.
*F15B 11/04* (2006.01)
*F15B 11/08* (2006.01)
*E02F 9/22* (2006.01)

(52) U.S. Cl.
CPC ..... *E02F 9/2296* (2013.01); *F15B 11/0406* (2013.01); *F15B 11/08* (2013.01)

(58) Field of Classification Search
CPC ..... F15B 11/0406; F15B 11/08; F15B 15/02; E02F 9/2296
See application file for complete search history.

(56) References Cited

U.S. PATENT DOCUMENTS 4,858,435 A 8/1989 Ikeda
10,150,657 B2 * 12/2018 Miyoshi ..... B66C 13/20
(Continued)

FOREIGN PATENT DOCUMENTS

CN 103502540 A 1/2014
CN 103562565 A 2/2014
(Continued)

OTHER PUBLICATIONS

International Search Report dated Jan. 8, 2019 in PCT/JP2018/038104 filed Oct. 12, 2018, citing documents AA and AO-AR therein, 2 pages.
(Continued)

*Primary Examiner* — Abiy Teka
*Assistant Examiner* — Daniel S Collins
(74) *Attorney, Agent, or Firm* — Oblon, McClelland, Maier & Neustadt, L.L.P.

(57) ABSTRACT

Provided is a slewing-type working machine including: a slewing motor; a capacity control device; a slewing control device operated by a slewing instruction operation to allow hydraulic fluid to be supplied from a hydraulic pump to the slewing motor; a slewing parking brake; a brake switching device; a brake release instruction unit which inputs a brake release instruction to the brake switching device so as to make the brake switching device switch the slewing parking brake to a brake releasing state after allowing hydraulic fluid to be supplied to the slewing motor; and a capacity limiting unit that limits the capacity of the slewing motor controlled by the capacity control device to a predetermined brake-release capacity value or less until a brake release point and allows the capacity to increase after the brake release point.

5 Claims, 4 Drawing Sheets

(56) References Cited

U.S. PATENT DOCUMENTS

| | | | | |
|---|---|---|---|---|
| 10,422,361 | B2 * | 9/2019 | Guo | B60L 7/24 |
| 2014/0007565 | A1 | 1/2014 | Yamashita et al. | |

FOREIGN PATENT DOCUMENTS

| | | | | |
|---|---|---|---|---|
| EP | 2 650 448 | A1 | | 10/2013 |
| EP | 2 696 081 | A1 | | 2/2014 |
| JP | 63-121666 | U | | 8/1988 |
| JP | 63-180372 | U | | 11/1988 |
| JP | 3-365 | U | | 1/1991 |
| JP | 10195932 | A | * | 7/1998 |
| JP | 2000-145711 | A | | 5/2000 |
| JP | 2010-65510 | A | | 3/2010 |
| JP | 2010-138587 | A | | 6/2010 |
| JP | 5304236 | B2 | | 7/2013 |

OTHER PUBLICATIONS

Extended European Search Report dated Oct. 29, 2020 in European Application 18876294.2, citing documents AA & AO-AP therein, 5 pages.

Chinese Office Action issued in Chinese Patent Application No. 201880069687.0 dated Jul. 6, 2021, (w/ English Translation).

* cited by examiner

PIVOTING WORK MACHINE

TECHNICAL FIELD

The present invention relates to a slewing-type working machine such as a hydraulic excavator.

BACKGROUND ART

A slewing-type working machine generally includes a base body, a slewing body slewably mounted on the base body, a slewing motor which slews the slewing body; a slewing control device which is operated to activate the slewing motor, by application of a slewing instruction operation for slewing the slewing body to the slewing control device; and a slewing parking brake. The slewing parking brake is a mechanical brake which applies a stop retention force to the slewing body independently from the slewing motor to reliably retain the slewing body in a stopped state in absence of the slewing instruction operation.

Regarding the control of the operation of such a slewing parking brake, Patent Literature 1, for example, discloses introducing a pilot pressure into a parking brake, the pilot pressure generated in response to a slewing instruction operation, to thereby switch the slewing parking brake to a brake releasing state.

For reliable retention of the slewing body in a stopped state, it is preferable to release the braking of the slewing parking brake after the slewing instruction operation is actually applied and a slewing torque is generated by the slewing motor. The release of the braking at such timing, however, may cause a possibility of slewing action of the slewing body that involves so-called dragging of the slewing parking brake that is applying the stop retention force to the slewing body when a large slewing torque is applied to the slewing body. The slewing operation involving such dragging may cause damage to the parking brake and other components.

Accordingly, in order to release the brake by the slewing parking brake with a delay from the application of the slewing instruction operation without the above damage, it is required to limit the slewing torque to be applied to the slewing body at the start of the slewing operation. However, in a typical working machine with a slewing body having a large weight, it is difficult for thus excessively limited slewing torque at the start of slewing to raise the slewing speed of the slewing body rapidly from the stopped state thereof.

CITATION LIST

Patent Literature

Patent Literature 1: Japanese Unexamined Patent Publication No. 2010-65510

SUMMARY OF INVENTION

An object of the present invention is to provide a slewing-type working machine including a slewing body and a slewing parking brake for holding the slewing body in a stopped state, the slewing-type working machine being capable of reliably retaining the slewing body in the stopped state by the slewing parking brake until a slewing torque is applied to the slewing body and protecting the slewing parking brake and other components from the slewing torque while enabling a slewing speed to be raised rapidly after the start of slewing.

Provided is a slewing-type working machine including: a base body; a slewing body slewably mounted on the base body; a slewing motor formed of a variable displacement hydraulic motor that is activated to apply a slewing torque for slewing the slewing body to the slewing body by supply of hydraulic fluid to the hydraulic motor; a capacity control device which controls a capacity of the slewing motor; a hydraulic pump which discharges hydraulic fluid to be supplied to the slewing motor; a slewing control device that is operated, by application of a slewing instruction operation for slewing to the slewing control device, to allow hydraulic fluid to be supplied from the hydraulic pump to the slewing motor to activate the slewing motor; a slewing parking brake switchable between a braking state of applying a stop retention force to the slewing body to retain the slewing body in a stopped state and a brake releasing state of releasing the slewing body to let the slewing body be stewed; a brake switching device which switches the slewing parking brake between the braking state and the brake releasing state; a brake release instruction unit which inputs a brake release instruction to the brake switching device to make the brake switching device switch the slewing parking brake from the braking state to the brake releasing state after the slewing control device is operated, by application of the slewing instruction operation to the slewing control device, to allow hydraulic fluid to be supplied from the hydraulic pump to the slewing motor device; and a capacity limiting unit that limits the capacity of the slewing motor which capacity is controlled by the capacity control device. The capacity limiting unit is configured to limit the capacity of the slewing motor controlled by the capacity control device to a predetermined brake-release capacity value or less until a brake release point in time when the slewing parking brake is switched to the brake releasing state in response to the input of the brake release instruction to the brake switching device after the slewing control device is operated, by application of the slewing instruction operation to the slewing control device, to allow hydraulic fluid to be supplied from the hydraulic pump to the slewing motor, and configured to permit the capacity control device to increase the capacity of the slewing motor beyond the brake-release capacity value after the brake release point.

DESCRIPTION OF EMBODIMENTS

There will be described preferable embodiments of the present invention with reference to the accompanying drawings.

Figure 4:
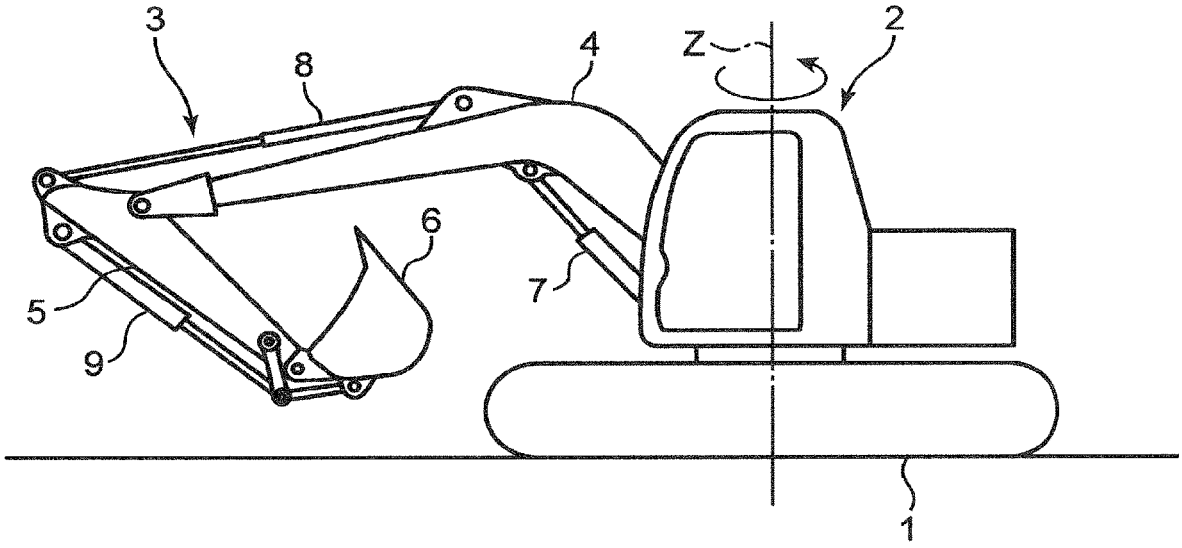
FIG. 4 is a side view of a hydraulic excavator that corresponds to the working machine according to each of the first to three embodiments.

FIG. 4 shows a hydraulic excavator corresponding to a working machine according to each of the embodiments. The hydraulic excavator includes a crawler-type lower travelling body 1 forming a base body, an upper slewing body 2 that is a slewing body mounted thereon slewably about a slewing central axis Z normal to the traveling plane of the lower travelling body 1, and an excavation attachment 3 mounted to the upper slewing body 2. The excavation attachment 3 includes a boom 4 capable of being raised and lowered, an arm 5 attached to a distal end of the boom 4, a bucket 6 attached to a distal end of the arm 5, and a plurality of hydraulic cylinders, namely, a boom cylinder 7, an arm cylinder 8, and a bucket cylinder 9 that are to actuate the boom 4, the arm 5, and the bucket 6, respectively.

The working machine according to the present invention shall not be limited to such a hydraulic excavator. The present invention is adoptable to various working machines including a base body and a slewing body slewably mounted thereon (e.g., a slewing crane). Besides, the base body shall not be limited to a traveling body like the lower travelling body 1 but be allowed to be any base provided at a specific location for supporting the slewing body.

Figure 1:
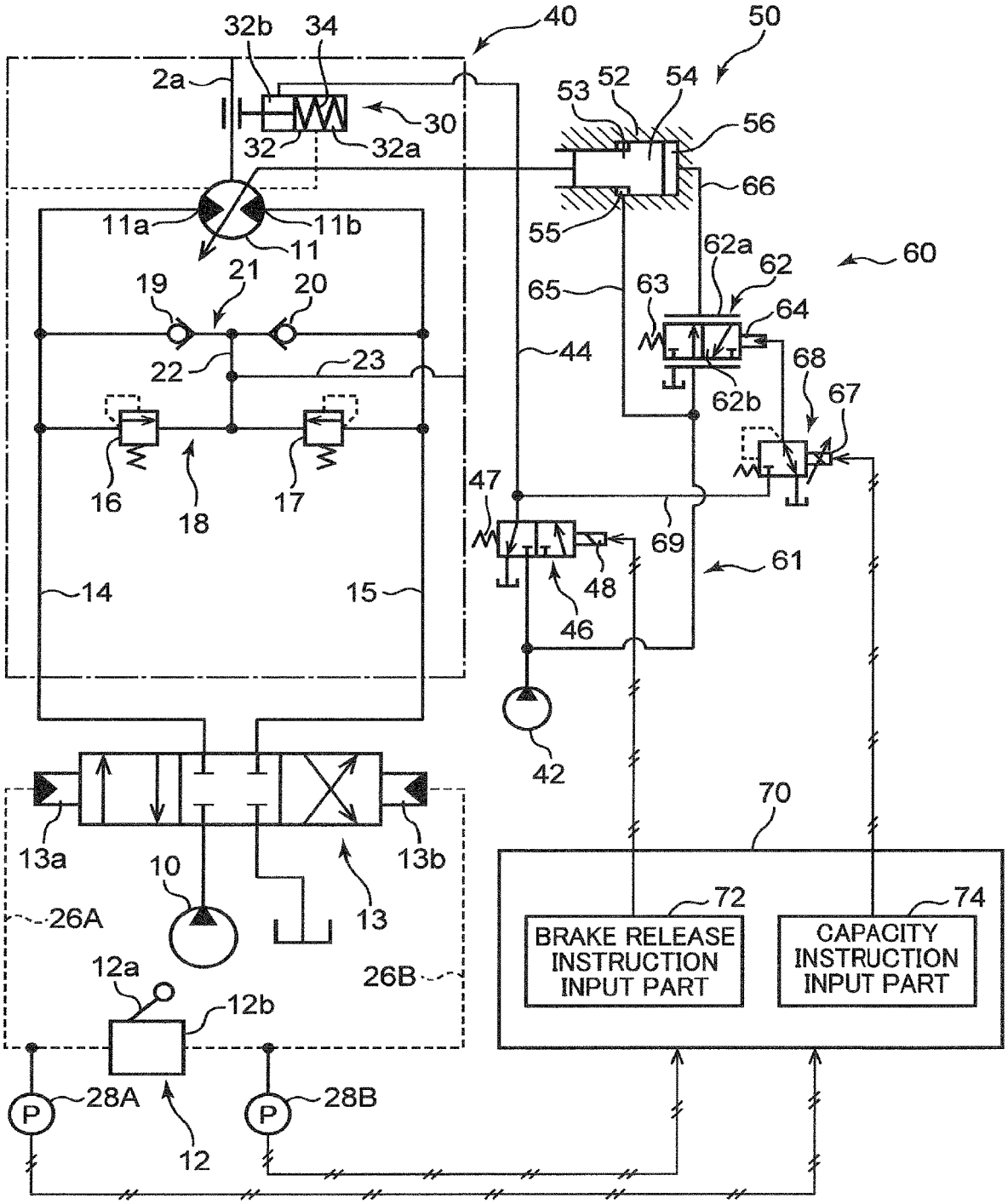
FIG. 1 shows a hydraulic circuit mounted, for slewing, on a working machine according to a first embodiment of the present invention.

FIG. 1 shows a hydraulic circuit according to a first embodiment of the present invention, which is an example of a circuit for slewing the upper slewing body 2. The circuit includes a hydraulic pump 10, a slewing motor 11, a slewing operation device 12, a control valve 13, a right slewing pipeline 14, a left slewing pipeline 15, a relief valve circuit 18, a check valve circuit 21, a communication line 22, and a makeup line 23.

The slewing motor 11 includes a hydraulic motor which is coupled to the upper slewing body 2, for example, a slewing shaft 2*a* thereof, and activated to apply a slewing torque for slewing the upper slewing body 2 to the upper slewing body 2 by supply of hydraulic fluid to the slewing motor 11. Specifically, the slewing motor 11 includes a right slewing port 11*a* connected with the right slewing pipeline 14 and a left slewing port 11*b* connected with the left slewing pipeline 15, being activated to apply a slewing torque in a direction of slewing the upper slewing body 2 rightward to the upper slewing body 2 while discharging hydraulic fluid through the left slewing port 11*b* by supply of hydraulic fluid to the right slewing port 11*a* and activated to apply a slewing torque in a direction of slewing the upper slewing body 2 leftward to the upper slewing body 2 while discharging hydraulic fluid through the right slewing port 11*a* by supply of hydraulic fluid to the left slewing port 11*b*.

The hydraulic motor that forms the slewing motor 11 is a variable displacement hydraulic motor having a variable capacity (displacement volume). The slewing torque applied to the upper slewing body 2 from the slewing motor 11 is increased with increase in the capacity of the slewing motor 11.

The hydraulic pump 10 is coupled to a not-graphically-shown engine mounted on the upper slewing body 2 and driven by the engine to thereby discharge hydraulic fluid to be supplied to the slewing motor 11.

The slewing operation device 12 and the control valve 13 constitute a slewing control device. The slewing control device is operated, by application of a slewing instruction operation for slewing the upper slewing body 2 to the slewing control device, to allow hydraulic fluid to be supplied from the hydraulic pump 10 to the slewing motor 11 to activate the slewing motor 11.

The control valve 13 lies between the hydraulic pump 10 and the slewing motor 11, being operated to change the flow direction and the flow rate of the hydraulic fluid to be supplied from the hydraulic pump 10 to the slewing motor 11. The control valve 13 shown in FIG. 1 is formed of a pilot-operated three-position hydraulic selector valve having a right slewing pilot port 13*a* and a left slewing pilot port 13*b*. With no input of a pilot pressure to either of the pilot ports 13*a*, 13*b*, the control valve 13 is kept at a neutral position that is a central position shown in FIG. 1, blocking both the slewing pipelines 14, 15 from the hydraulic pump 10 to hinder the slewing motor 11 from rotating. By an input of a pilot pressure to the right slewing pilot port 13*a*, the control valve 13 is switched from the neutral position to a right slowing position, the left position in FIG. 1, by a stroke corresponding to the magnitude of the pilot pressure, allowing hydraulic fluid to be supplied from the hydraulic pump 10 to the right slewing port 11*a* of the slewing motor 11 through the right slewing pipeline 14 at the flow rate corresponding to the stroke while allowing hydraulic fluid discharged from the left slewing port 11*b* to return to a tank through the right left slewing pipeline 15. Conversely, by an input of the pilot pressure to the left slewing pilot port 13*b*, the control valve 13 is switched from the neutral position to a left slewing position, the right position in FIG. 1, by a stroke corresponding to the pilot pressure, allowing hydraulic fluid to be supplied from the hydraulic pump 10 to the left slewing port 11*b* of the slewing motor 11 through the left slewing pipeline 15 at the flow rate corresponding to the stroke while allowing the hydraulic fluid discharged from the right slewing port 11*a* to return to the tank through the right slewing pipeline 14.

The slewing operation device 12 includes an operative lever 12*a* and a pilot valve 12*b*. The operative lever 12*a* is an operation member, which is capable of rotational movement in a direction in which the slewing instruction operation is applied by an operator to the operative lever 12*a*. The pilot valve 12*b* includes an inlet port connected with a not-graphically-shown pilot hydraulic pressure source, and a pair of outlet ports, which are connected with the right slewing pilot port 13*a* and the left slewing pilot port 13*b* through a right slewing pilot line 26A and a left slewing pilot line 26B, respectively. The pilot valve 12*b* is coupled to the operative lever 12*a* and configured to open so as to allow a pilot pressure corresponding to the magnitude of the slewing instruction operation to be applied from the pilot hydraulic pressure source to the corresponding pilot port that is one of the right slewing pilot port 13*a* and the left slewing pilot port 13*b* and corresponds to the direction in which the slewing instruction operation is applied to the operative lever 12*a*.

The relief valve circuit 18, the check valve circuit 21, the communication line 22, and the makeup line 23 constitute a circuit unit for braking the slewing motor 11 when the control valve 13 is returned to the neutral position. These components are not essential in the present invention.

The relief valve circuit 18 interconnects the right slewing pipeline 14 and the left slewing pipeline 15 so as to bypass the slewing motor 11. The relief valve circuit 18 includes a left slewing relief valve 16 and a right slewing relief valve 17. The left and right slewing relief valves 16, 17 are arranged with connection of the inlet port of the left slewing relief valve 16 to the right slewing pipeline 14, connection of the inlet port of the right slewing relief valve 17 to the left slewing pipeline 15, and interconnection of the outlet ports of the relief valves 16, 17.

The check valve circuit 21 interconnects the slewing pipelines 14, 15 at a position closer to the slewing motor 11 than the relief valve circuit 18. The check valve circuit 21 includes a left slewing check valve 20 and a right slewing check valve 19. The left slewing check valve 20 is oriented to hinder hydraulic fluid from flowing from the left slewing pipeline 15, and the right slewing check valve 19 is oriented to hinder hydraulic fluid from flowing in from the right slewing pipeline 14.

The communication line 22 connects the relief valve circuit 18 at a position between the left and right slewing relief valves 16, 17 and the check valve circuit 21 at a point between the right and left slewing check valves 19, 20 to each other. The makeup line 23 interconnects the communication line 22 and the tank so as to allow hydraulic fluid to be taken up from the tank to the communication line 22 through the makeup line 23 by a negative pressure in the communication line 22 to thereby prevent a cavitation. The makeup line 23 is provided with a not-graphically-shown backpressure valve.

In the circuit unit, when the operation lever 12*a* is returned to a neutral position to return the control valve 13 from the right slewing position to the neutral position, for example, during the right slewing, the control valve 13 blocks each of the slewing pipelines 14, 15 from the hydraulic pump 10 whereas the slewing motor 11 is continued to be rotated in a right slewing direction by the inertia of the upper slewing body 2. This raises the pressure in the left slewing pipeline 15 on a meter-out side. When thus raised pressure attains the set value of the right slewing relief valve 17, the right slewing relief valve 17 is opened to allow hydraulic fluid in the left slewing pipeline 15 to flow into the slewing motor 11 through the right slewing relief valve 17, the communication line 22, the right slewing check valve 19, and the right slewing pipeline 14. This allows a braking force to be applied, due to the action of the right slewing relief valve 17, to the slewing motor 11 that is still rotated by its inertia, thereby decelerating and finally stopping the slewing motor 11. The same operations are applied to deceleration/stop from the left slewing.

The hydraulic excavator further includes a slewing parking brake 30, a brake switching device 40, a capacity operation part 50, a hydraulic pressure supply control part 60, a capacity pilot line 69, a pilot pressure operation valve 68, a right slewing pilot sensor 28A and a left slewing pilot sensor 28B, and a controller 70.

The slewing parking brake 30 is a braking device which applies a mechanical stop retention force to the upper slewing body 2 to retain the upper slewing body 2 in a stopped state at least when the upper slewing body 2 is not driven by the slewing motor 11, that is, at least when the slewing motor 11 applies no slewing torque to the upper slewing body 2. The slewing parking brake 30 is switchable between a braking state of applying a stop retention force to the upper slewing body 2 and a brake releasing state of releasing the upper slewing body 2 to let the slewing body 2 be slewed.

The slewing parking brake 30 in the embodiment is a hydraulic negative brake, which is kept in the braking state when receiving no supply of a brake releasing pressure and is switched to the brake releasing state only when receiving a supply of the brake releasing pressure. Specifically, the slewing parking brake 30 includes a hydraulic cylinder 32 and a spring 34, the hydraulic cylinder 32 having a spring chamber 32*a* as a first hydraulic pressure chamber and a brake releasing chamber 32*b* as a second hydraulic pressure chamber located on the opposite side to the spring chamber 32*a*, the spring 34 being housed in the spring chamber 32*a*. When no brake releasing pressure is supplied to the brake releasing chamber 32*b*, the slewing parking brake 30 applies a restraining force, i.e., the stop retention force, to a specific portion, e.g., the slewing shaft 2*a* shown in FIG. 1, of the upper slewing body 2 through the elastic force of the spring 34. Conversely, when a brake releasing pressure is supplied to the brake releasing chamber 32*b*, the brake releasing pressure acts on the hydraulic cylinder 32 as a brake releasing force for releasing the application of the restraining force against the elastic force of the spring 34.

The brake switching device 40 switches the slewing parking brake 30 between the braking state and the brake releasing state through the supply of the brake releasing pressure to the slewing parking brake 30 and the stop of the supply thereto. Specifically, the brake switching device 40 includes a pilot pump 42 connected to the brake releasing chamber 32*b* through a brake releasing line 44, and a brake selector valve 46 provided in the brake releasing line 44.

The pilot pump 42 is driven by the engine to thereby discharge pilot oil. The pilot oil is supplied to the brake releasing chamber 32*b* through the brake releasing line 44, thereby generating the brake releasing pressure in the brake releasing chamber 32*b*.

The brake selector valve 46 in the embodiment is a two-position solenoid operated selector valve having a solenoid 48. When no brake release instruction is input to the solenoid 48, the instruction being a current to excite the solenoid 48, the brake selector valve 46 is kept at a closing position that is a braking position on the left in FIG. 1 to close the brake releasing line 44, thereby hindering the brake releasing pressure to be supplied from the pilot pump 42 to the brake releasing chamber 32*b*. Conversely, When the brake release instruction is input to the solenoid 48, the brake selector valve 46 is switched to an opening position that is a brake releasing position on the right in FIG. 1 to open the brake releasing line, thereby allowing the brake releasing pressure to be supplied from the pilot pump 42 to the brake releasing chamber 32*b*.

The capacity operation part 50 and the hydraulic pressure supply control part 60 combine with the controller 70 to constitute a capacity control device. The capacity control device hydraulically controls a capacity, i.e., displacement, of the slewing motor 11 in response to the slewing instruction operation applied to the operation lever 12*a*.

The capacity operation part 50 is operated, by supply of a capacity operation hydraulic pressure that is controlled by the hydraulic pressure supply control part 60, to change the capacity of the slewing motor 11. The capacity operation part 50 includes a capacity operating cylinder 52 enclosing a piston chamber and a capacity operation piston 54 installed in the piston chamber of the capacity operating cylinder 52. The capacity operation piston 54 is capable of axial displacement in the piston chamber so as to slide on the internal surface of the capacity operating cylinder 52, while being coupled to the slewing motor 11 so as to change the capacity of the slewing motor 11 through the axial displacement. For example, the capacity operation piston 54 changes inclination of a swash plate in the slewing motor 11 if being of an axial piston type.

Specifically, the capacity operation piston 54 is coupled to the slewing motor 11 through a rod 53 extending from the capacity operation piston 54 through the first hydraulic pressure chamber 55. The capacity operation piston 54 partitions the piston chamber 52 into the first hydraulic pressure chamber 55 and a second hydraulic pressure chamber 56 and increase the capacity of the slewing motor 11 through the displacement thereof in a direction of increasing the volume of the first hydraulic pressure chamber 55 (i.e., rightward in FIG. 1). The axial position of the capacity operation piston 54 depends on the balance between a first capacity operation hydraulic pressure to be supplied to the first hydraulic pressure chamber 55 and a second capacity operation hydraulic pressure to be supplied to the second hydraulic pressure chamber 56. Specifically, the capacity operation piston 54 is displaced in a direction of increasing the capacity of the slewing motor 11 (i.e., rightward in FIG. 1) with decrease in the first capacity operation hydraulic pressure relative to the second capacity operating pressure.

The capacity operation piston 54 has a first pressure receiving area facing the first hydraulic pressure chamber 55, the first pressure receiving area being an area where the capacity operation piston 54 receives the capacity operation hydraulic pressure and being smaller than a second pressure receiving area facing the second hydraulic pressure chamber 56 by a cross-sectional area of the rod 53. The difference between the cross-sectional areas allows the capacity operation piston 54 to be located at the position that maximizes the volume of the second hydraulic pressure chamber 56, that is, the position that minimizes the capacity of the slewing motor 11, on the leftmost side in FIG. 1, when the first capacity operation hydraulic pressure and the second hydraulic pressure operation capacity pressure are equivalent to each other.

The hydraulic pressure supply control part 60 controls the position of the capacity operation piston 54 by changing the balance between the first capacity operation hydraulic pressure and the second capacity operation hydraulic pressure, thereby controlling the capacity of the slewing motor 11 corresponding to the position. The supply control part 60 in this embodiment, which is a part to perform and further change the supply of the capacity operation hydraulic pressure to the capacity operation part 50 by utilization of the oil discharged from the pilot pump 42 of the brake switching device 40, includes a hydraulic pressure supply line 61 and a hydraulic pressure supply control valve 62 as shown in FIG. 1.

The hydraulic pressure supply line 61 is connected to the pilot pump 42 in parallel with the brake switching valve 46 and introduces the oil discharged from the pilot pump 42 to the capacity operation part 50 to thereby supply the capacity operation hydraulic pressure to the first hydraulic pressure chamber 55 and the second hydraulic pressure chamber 56 of the capacity operation part 50. Specifically, the hydraulic pressure supply line 61 branches off from the brake releasing line 44 at a position upstream of the brake selector valve 46 in the brake switching device 40. Furthermore, the hydraulic pressure supply line 61 bifurcates into a first hydraulic pressure line 65 connected to the first hydraulic pressure chamber 55 and a second hydraulic pressure line 66 connected to the second hydraulic pressure chamber 56.

The hydraulic pressure supply control valve 62 is provided in the second hydraulic pressure line 66 and configured to reduce the second capacity operation hydraulic pressure to be supplied to the second hydraulic pressure chamber 56 through the second hydraulic pressure line 66 by a degree corresponding to a capacity pilot pressure applied to the hydraulic pressure supply control valve 62, relatively to the first capacity operation hydraulic pressure to be supplied to the first hydraulic pressure chamber 55 through the first hydraulic pressure line 65.

The hydraulic pressure supply control valve 62 in this embodiment is formed of a pilot-operated servo valve, including a sleeve 62*a*, a spool 62*b* installed slidably in the sleeve 62*a*, a spring 63, and a pilot port 64. The spring 63 and the pilot port 64 is disposed at axially opposite positions of the spool 62*b*, respectively. When no capacity pilot pressure is supplied to the pilot port 64, the spool 62*b* is retained at a full opening position (the left position in FIG. 1) to open the second hydraulic pressure line 66 with a maximal opening area, by the spring force of the spring 63. By the supply of the capacity pilot pressure to the pilot port 64, the spool 62*b* is displaced in a closing direction (leftward in FIG. 1) from the full opening position by a stroke corresponding to the magnitude of the capacity pilot pressure, thereby reducing the second capacity operation hydraulic pressure supplied to the second hydraulic pressure chamber 56 relatively to the first capacity operation hydraulic pressure to be supplied to the first hydraulic pressure chamber 55.

The capacity pilot line 69 introduces the oil discharged from the pilot pump 42 of the brake switching device 40 to the pilot port 64 of the hydraulic pressure supply control valve 62 to thereby provide the capacity pilot pressure to the pilot port 64. Specifically, the capacity pilot line 69 has an upstream end connected to the brake releasing line 44 and a downstream end connected with the pilot port 64.

The pilot pressure operation valve 68 is provided in the capacity pilot line 69 and configured to be opened by an input of a capacity instruction to the pilot pressure operation valve 68, by an opening degree corresponding to the magnitude of the capacity instruction, thereby changing the capacity pilot pressure supplied to the pilot port 64. The pilot pressure operation valve 68 in this embodiment is formed of a solenoid proportional valve with a solenoid 67. The solenoid 67 is supplied with an excitation current as the capacity instruction. When no excitation current is supplied (that is, no capacity instruction is input) to the solenoid 67, the pilot pressure operation valve 68 is closed to block the capacity pilot line 69 and to bring the pilot port 64 into communication with the tank, thereby hindering capacity pilot pressure from being supplied to the pilot port 64; when an excitation current is supplied (that is, the capacity instruction is supplied) to the solenoid 67, the pilot pressure operation valve 68 opens the capacity pilot line 69 by an opening degree corresponding to the magnitude of the excitation current, thereby allowing capacity pilot pressure having the magnitude corresponding to the opening degree to be supplied to the pilot port 64.

The embodiment involves, as the feature thereof, that the upstream end of the capacity pilot line 69 is connected to the brake releasing line 44 at a position downstream of the brake selector valve 46. This allows the brake selector valve 46 to bring the pilot port 64 into communication with the tanks, when switched to the braking position (the left position in FIG. 1), to hinder the capacity pilot pressure to be supplied to the pilot port 64 regardless of opening or closing of the pilot pressure operation valve 68.

The right slewing pilot sensor 28A and the left slewing pilot sensor 28B generate respective pilot pressure detection signals corresponding to the right slewing pilot pressure in the right slewing pilot line 26A and corresponding to the left slewing pilot pressure in the left slewing pilot line 26B, respectively, and input them to the controller 70. Thus, the right and left slewing pilot pressure sensors 28A, 28B detects the application of the slewing instruction operation to the operative lever 12*a* of the slewing operation device 12 and provides the information thereon to the controller 70.

The controller 70 is formed of, for example, a microcomputer, including components relevant to the present invention, namely, a brake release instruction input part 72 and a capacity instruction input part 74 shown in FIG. 1.

The brake release instruction input part 72 is combined with the right and left slewing pilot sensors 28A, 28B to constitute a brake release instruction unit. Specifically, when either of the right and left slewing pilot pressure sensors 28A, 28B detects the application of the slewing instruction operation to the slewing operation device 12, the brake release instruction input part 72 inputs the brake release instruction to the solenoid 48 of the brake selector valve 46 so as to switch the slewing parking brake 30 from the braking state to the brake releasing state, after the control valve 13 is opened by the slewing instruction operation to allow hydraulic fluid to be supplied from the hydraulic pump 10 to the slewing motor 11. The time period from the point in time when the slewing instruction operation is applied to the point in time when the slewing parking brake 30 is switched to the brake releasing state (brake release point) is set at a very short time period enough to allow the slewing parking brake 30 to reliably retain the upper slewing body 2 in a stopped state until the slewing body 2 starts to slew in response to an actual activation of the slewing motor 11. The very short time period may correspond to a spontaneous time lag itself from the point in time when either of the right and left slewing pilot pressure sensors 28A, 28B detects the slewing instruction operation to the point in time when the brake selector valve 46 is actually switched to the brake releasing position. Alternatively, the brake release instruction input part 72 may incorporate a timer and input the brake release instruction to the solenoid 48 of the brake selector valve 46 after the lapse of the very short time period from the point in time when the slewing instruction operation is detected.

The capacity instruction input part 74 generates a capacity instruction for a larger capacity as the slewing speed of the upper slewing body 2 designated by the slewing instruction operation (corresponding to the operational speed of the slewing motor 11) becomes larger, and input the generated capacity instruction to the solenoid 67 of the pilot pressure operation valve 68. Thus, the capacity instruction input part 74 performs the generation and input of the capacity instruction so as to increase the capacity pilot pressure to be applied to the pilot port 64 of the hydraulic pressure supply control valve 62 with increase in the slewing speed corresponding to the slewing instruction operation.

Next will be described below the actions of the hydraulic circuit.

When the operation lever 12*a* of the slewing operation device 12 is at the neutral position, no pilot pressure is supplied to either of the right and left slewing pilot ports 13*a*, 13*b*, keeping the control valve 13 at the neutral position. The slewing motor 11 therefore applies no slewing torque to the upper slewing body 2. Meanwhile, the brake release instruction input part 72 of the controller 70 inputs no brake release instruction to the solenoid 48 of the brake selector valve 46, thereby keeping the brake selector valve 46 at the closing position, the braking position. The brake selector valve 46 kept at the braking position blocks the brake releasing line 44 and brings the brake releasing chamber 32*b* of the slewing parking brake 30, which is a negative brake, into communicate with the tank, thereby retaining the slewing parking brake 30 in the braking state of applying a stop retention force to the upper slewing body 2.

During such retention of the slewing parking brake 30 in the braking state by the brake switching device 40, the capacity control device keeps the capacity of the slewing motor 11 at a minimum capacity. Specifically, the capacity pilot line 69, which is connected to the brake releasing line 44 at the position downstream of the brake selector valve 48 (i.e., at the position opposite to the pilot pump 42), is brought into communication with the tank through the brake selector valve 48 at the braking position, thus hindering any capacity pilot pressure from being inputted to the pilot port 64 of the hydraulic pressure supply control valve 62 regardless of the opening degree of the pilot pressure operation valve 68. The hydraulic pressure supply control valve 62 is thereby kept at the full opening position to keep the second capacity operation hydraulic pressure that is supplied to the second hydraulic pressure chamber 56 of the capacity operation part 50 be equivalent to the first operation hydraulic pressure that is supplied to the first hydraulic pressure chamber 55. The capacity operation piston 54 is retained at the position to maximize the volume of the second hydraulic pressure chamber 56 (i.e., at the leftmost position in the FIG. 1) by the difference between the pressure receiving area facing the second hydraulic pressure chamber 56 and the pressure receiving area facing the first hydraulic pressure chamber 55, keeping the capacity of the slewing motor 11 be the minimum capacity.

Upon rotational movement of the slewing lever 12*a* in a specific operational direction, namely, a right-slewing operation direction or a left-slewing operation direction, involved by the application of a slewing instruction operation to the slewing lever 12, a pilot pressure is supplied from the pilot valve 12*b* of the slewing operation device 12 to one pilot port of the right and left slewing pilot ports 13*a*, 13*b* of the control valve 13, the one pilot corresponding to the specific operating direction, through the pilot line 26A (or 26B). This causes the control valve 13 to be switched to one slewing position of the right and left slewing positions, the one slewing position corresponding to the specific direction, to allow hydraulic fluid to be supplied from the hydraulic pump 10 to the right slewing port 11*a* or the left slewing port 11*b* of the slewing motor 11. The slewing motor 11 applies to the upper slewing body 2 a slewing torque in the direction corresponding to the port to which the hydraulic fluid is supplied.

At this point in time, the brake selector valve 46 is still kept at the closing position (braking position), hindering pilot oil from being supplied from the pilot pump 42 to the brake releasing chamber 32*b* of the hydraulic cylinder 32 in the slewing parking brake 30 through the brake releasing line 44, while bringing the pilot port 64 of the hydraulic pressure supply control valve 62 into communication with the tank to keep the minimum capacity of the slewing motor 11. This makes it possible to hinder the slewing torque applied to the upper slewing body 2 by the slewing motor 11 from exceeding the stop retention force (torque) by the slewing parking brake 30 and to limit the torque to a smaller value than it. Thus can be prevented a slewing start involving so-called dragging of the slewing parking brake 30 caused by start of slewing with a maximum torque against the braking state of the slewing parking brake 30.

In response to the occurrence of the pilot pressure, the right slewing pilot sensor 28A or the left slewing pilot sensor 28B generates a pilot pressure detection signal and inputs it to the controller 70. In the case where the detected pilot pressure is equal to or more than a predetermined value, the brake release instruction input part 72 judges that the slewing instruction operation is applied to the operative lever 12*a* and, after the lapse of the predetermined very short time period from the above judgement, inputs a brake release instruction to the solenoid 48 of the brake selector valve 46 to open the brake selector valve 46. The thus opened brake selector valve 46 allows pilot oil to be supplied from the pilot pump 42 to the brake releasing chamber 32*b* of the hydraulic cylinder 32 in the slewing parking brake 30 through the brake releasing line 44 to switch the slewing parking brake 30 from the current braking state to the brake releasing state and, simultaneously, allows the oil discharged from the pilot pump 42 to be introduced into the pilot port 64 of the hydraulic pressure supply control valve 62 through the brake releasing line 44 and the capacity pilot line 69, thereby permitting the capacity of the slewing motor 11 to increase from the minimum capacity to the maximum capacity through the opening of the pilot pressure operation valve 68.

Thus permitting the capacity of the slewing motor 11 to be increased in maximum, that is, releasing prohibition of the increase in the capacity, enables the upper slewing body 2 to be started by a slewing torque which increases in response to the slewing instruction operation applied by an operator to the operative lever 12*a*, thereby allowing the slewing speed of the upper slewing body 2 to be raised rapidly in spite of the large weight thereof. Furthermore, opening the brake selector valve 46 reliably synchronizes the permission (i.e., the release of prohibition) to increase the slewing torque and the switching of the slewing parking brake 30 to the brake releasing state with each other, which prevents the slewing parking brake 30 or other components from being damaged due to the dragging of the slewing parking brake 30 caused by the application of an excessive torque (e.g., a torque which is notably greater than the torque corresponding to the minimum capacity of the slewing motor 11, e.g., the maximum torque) to the upper slewing body 2 against the braking state of the slewing parking brake 30.

The aforementioned synchronization between the permission to increase the slewing torque and the switching to the brake releasing state means that the brake release point and the starting point of the permission to increase the slewing torque are coincident with each other enough to enable the upper slewing body 2 to be reliably prevented from being slewed involving dragging of the slewing parking brake 30 caused by the increase in the slewing torque in advance of the switching of the slewing parking brake 30 from the braking state to the brake releasing state. Accordingly, the "synchronization" here is aimed to accept a slight difference between the above two points under the condition of reliably preventing the slewing with the dragging.

In the first embodiment, the above described branch of the capacity pilot line 69 from the brake releasing line 44 at the position downstream of the brake selector valve 46, in other words, the connection of the upstream end of the capacity pilot line 69 to the brake releasing line 44 at the position downstream of the brake selector valve 46, enables the release of the brake in the slewing parking brake 30 and the permission to increase the slewing torque to be reliably synchronized with each other, with simple structure. For example, even if the point in time when the capacity instruction input part 74 inputs the capacity instruction of increasing the pilot pressure to the pilot pressure operation valve 68 precedes the point in time when the brake release instruction input part 72 inputs the brake release instruction to the brake selector valve 46 (brake release point) after the application of the slewing instruction operation to the operative lever 12*a*, the point in time when the capacity is actually permitted to increase (i.e., the point in time when the pilot port 64 of the hydraulic pressure supply control valve 62 is supplied with the pilot pressure) can be reliably synchronized with the brake release point.

Figure 2:
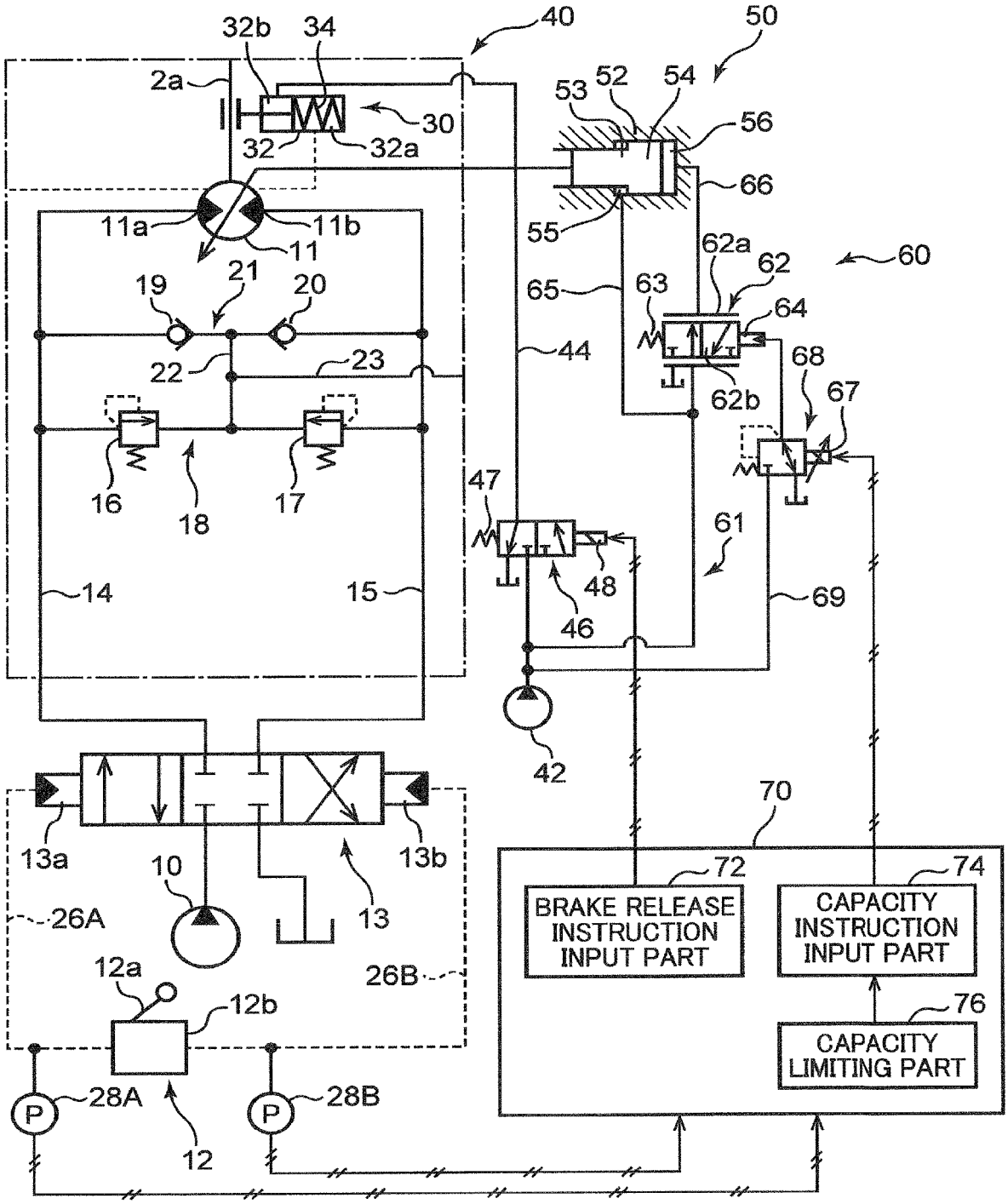
FIG. 2 shows a hydraulic circuit mounted, for slewing, on a working machine according to a second embodiment of the present invention.

The present invention, however, should not be limited to the first embodiment. The present invention encompasses also a mode where a capacity pilot line 69 branches off at a position upstream of a brake selector valve. FIG. 2 shows a second embodiment as the example of the mode.

The capacity pilot line 69 in the second embodiment branches off from a brake releasing line 44 at a position upstream of a brake selector valve 46 and is connected to a first hydraulic pressure line 65 of a hydraulic pressure supply control part 60. Specifically, the capacity pilot line 69 has an upstream end which is connected to a pilot pump 42 directly so as to bypass the brake selector valve 46, introducing oil discharged from the pilot pump 42 directly to a pilot port 64 of a hydraulic pressure supply control valve 62.

On the other hand, a controller 70 includes a capacity limiting part 76 in addition to a brake release instruction input part 72 and a capacity instruction input part 74 corresponding to those in the first embodiment. The capacity limiting part 76 inputs to the capacity instruction input part 74 a capacity limiting instruction for limiting the capacity of a slewing motor 11 to the minimum capacity at least until the lapse of a predetermined very short time from judgment that a slewing instruction operation is applied to an operative lever 12*a*, that is, until a brake release point in time when the brake release instruction input part 72 inputs a brake release instruction to a brake selector valve 46. The capacity limiting part 76 cancels the capacity limiting instruction at the brake release point or upon the lapse of a predetermined very short time period from the brake release point. When receiving the input of the capacity limiting instruction, the capacity instruction input part 74 suspends the input of a capacity instruction to a pilot pressure operation valve 68 regardless of presence or absence of the slewing instruction operation to keep the capacity of the hydraulic motor 11 at the minimum one.

Also in this the second embodiment, it is possible to reduce the number of components by utilization of the pilot pump 42 in a brake switching device 40 as means for making a capacity control device perform capacity increasing action. Moreover, by synchronizing the point of switching the slewing parking brake 30 to a brake releasing state, namely, the brake release point, with the point of permitting (releasing prohibit) increasing the capacity of the slewing motor 11, the capacity limiting part 76 enables a slewing parking brake 30 to be prevented from dragging, similarly to the first embodiment.

The present invention, however, should not be limited to a mode of utilizing a pilot pump in a brake switching device in order to increase the capacity of a slewing motor. Specifically, the present invention further encompasses another mode including a hydraulic source other than the pilot pump to increase the capacity of a slewing motor.

Figure 3:
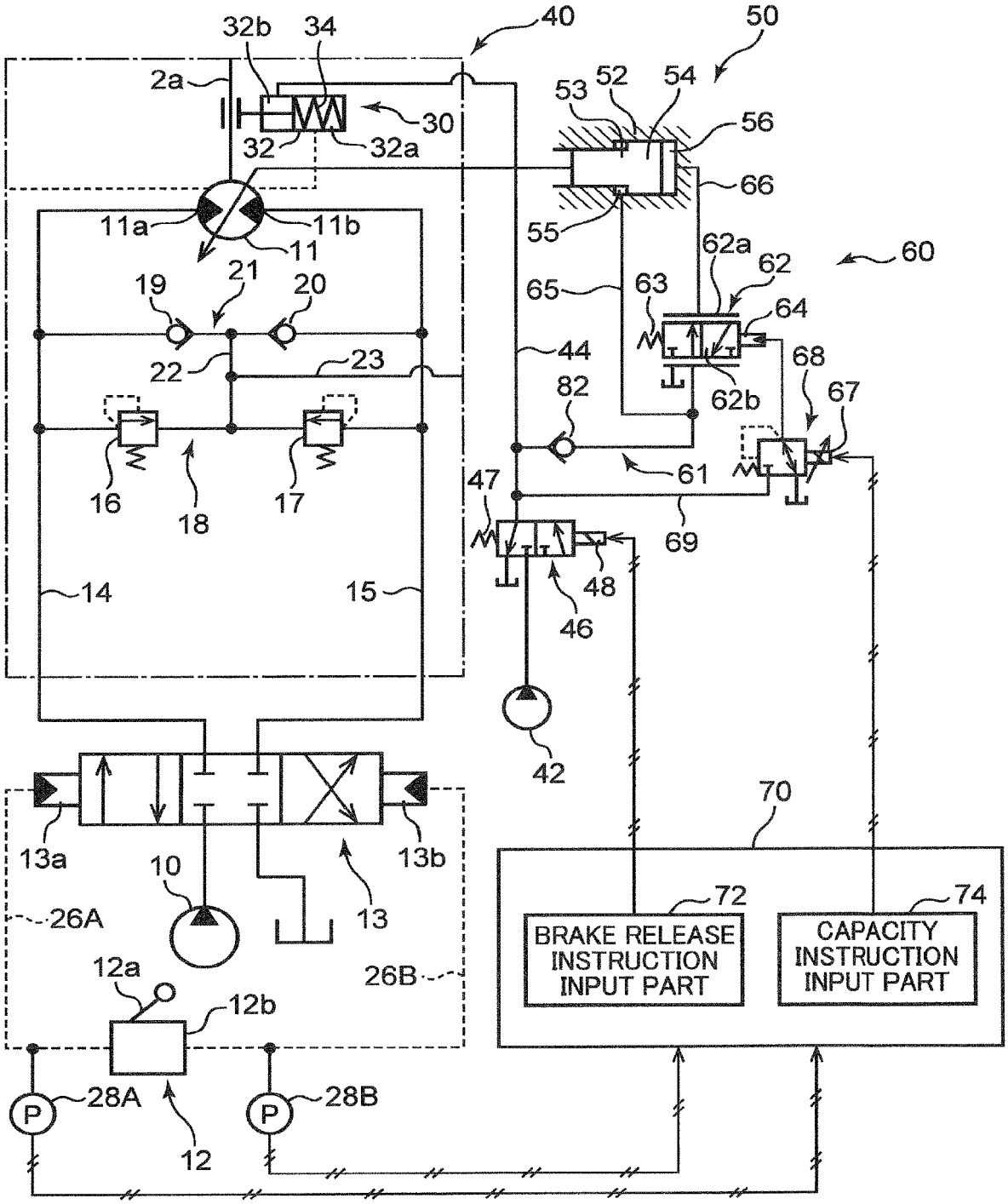
FIG. 3 shows a hydraulic circuit mounted, for slewing, on a working machine according to a third embodiment of the present invention.

Besides, the supply of the capacity operation hydraulic pressure to the capacity operation part 50 is not limited to one by utilization of the pilot pump 42 but permitted to be done by a pump separated from the pilot pump 42. Alternatively, a third embodiment shown in FIG. 3 includes a hydraulic pressure supply control part 60 with a hydraulic pressure supply line 61 that has an upstream end connected to a brake releasing line 44 at a position downstream of a brake selector valve 46. In this mode, it is more preferable to provide the hydraulic pressure supply line 61 with a check valve 82 for hindering oil from flowing backward from a capacity operation part 50 to the brake releasing line 44 as shown in FIG. 3. The check valve 82 enables a capacity operation hydraulic pressure to be supplied to the capacity operation part 50 even when the brake selector valve 46 is switched to a braking position, which is a position for blocking the brake releasing line 44 and bringing a brake releasing chamber 32*b* into communication with a tank.

As described above, a slewing-type working machine including a slewing body and a slewing parking brake for retaining the slewing body in a stopped state is provided, the slewing-type working machine being capable of reliably retaining the slewing body in the stopped state by the slewing parking brake until a slewing torque is applied to the slewing body and protecting the slewing parking brake and other components from the slewing torque while enabling a slewing speed after the start of slewing to be raised rapidly after start of the slewing.

Provided is a slewing-type working machine including: a base body; a slewing body slewably mounted on the base body; a slewing motor formed of a variable displacement hydraulic motor that is activated to apply a slewing torque for slewing the slewing body to the slewing body by supply of hydraulic fluid to the hydraulic motor; a capacity control device which controls a capacity of the slewing motor; a hydraulic pump which discharges hydraulic fluid to be supplied to the slewing motor; a slewing control device that is operated, by application of a slewing instruction operation for slewing to the slewing control device, to allow hydraulic fluid to be supplied from the hydraulic pump to the slewing motor to activate the slewing motor; a slewing parking brake switchable between a braking state of applying a stop retention force to the slewing body to retain the slewing body in a stopped state and a brake releasing state of releasing the slewing body to let the slewing body be slewed; a brake switching device which switches the slewing parking brake between the braking state and the brake releasing state; a brake release instruction unit which inputs a brake release instruction to the brake switching device to make the brake switching device switch the slewing parking brake from the braking state to the brake releasing state after the slewing control device is operated to allow hydraulic fluid to be supplied from the hydraulic pump to the slewing motor device by application of the slewing instruction operation to the slewing control device; and a capacity limiting unit that limits the capacity of the slewing motor which capacity is controlled by the capacity control device. The capacity limiting unit is configured to limit the capacity of the slewing motor controlled by the capacity control device to a predetermined brake-release capacity value or less until a brake release point in time when the slewing parking brake is switched to the brake releasing state in response to the input of the brake release instruction to the brake switching device after the slewing control device is operated to allow hydraulic fluid to be supplied from the hydraulic pump to the slewing motor by application of the slewing instruction operation to the slewing control device, and configured to permit the capacity control device to increase the capacity of the slewing motor beyond the brake-release capacity value after the brake release point.

In the slewing-type working machine, the brake release instruction unit provides the brake release instruction to the brake switching device to switch the slewing parking brake from the braking state to the brake releasing state after the slewing control device is operated by application of the slewing instruction operation thereto to make the supply of the hydraulic fluid from the hydraulic pump to the slewing motor start, thereby enabling the slewing body to be reliably retained in the stopped state until a slewing torque is applied thereto. In addition, the capacity limiting unit, which limits the capacity of the slewing motor to the predetermined brake-release capacity value or less (preferably, to the minimum capacity of the slewing motor) at least until the brake release point and permits the capacity of the slewing motor to increase beyond the brake-release capacity value after the brake release point, allows the capacity of the slewing motor to be increased after the braking state is released to thereby raise the slewing speed of the slewing body rapidly, while avoiding a damage to the slewing parking brake that may be caused if an excessive torque is applied to the slewing body in the braking state in which the stop retention force is applied to the slewing body from the slewing parking brake.

In the case where the slewing instruction operation is an operation for designating a slewing speed of the slewing body, it is preferable that the capacity control device is configured to increase the capacity of the slewing motor with increase in the slewing speed designated by the slewing instruction operation and that the capacity limiting unit is configured to limit the capacity of the slewing motor to the brake-release capacity value or less regardless of the slewing speed designated by the slewing instruction operation until the brake release point. This allows the acceleration to be performed for starting the slewing operation at a specific degree corresponding to the slewing instruction operation after the brake release point while preventing the dragging from occurring at the brake release point.

Regarding the specific configuration of the braking mechanism of the slewing-type working machine, in which the slewing parking brake is a hydraulic negative brake configured to be kept in the braking state when no brake releasing pressure is applied thereto and to be switched to the brake releasing state by supply of the brake releasing pressure thereto, it, is preferable that the brake switching device includes: a pilot pump which discharges a pilot oil to be supplied to the slewing parking brake through a brake releasing line to generate a brake releasing pressure in the slewing parking brake: and a brake selector valve which is provided in the brake releasing line and switchable between a brake releasing position to open the brake releasing line to allow pilot oil to be supplied to the slewing parking brake to thereby switch the slewing parking brake to the brake releasing state and a braking position to close the brake releasing line to thereby hinder pilot oil from being supplied to the slewing parking brake to retain the slewing parking brake in the braking state, the brake selector valve being configured to be switched to the brake releasing position by the brake release instruction input to the brake selector valve.

In this mode, the capacity control device preferably includes: a capacity operation part that is operated by supply of a capacity operation hydraulic pressure to change the capacity of the slewing motor; a hydraulic pressure supply control part that is operated by supply of capacity pilot pressure to change a mode of supply of the capacity operation hydraulic pressure to the capacity operation part so as to increase the capacity of the slewing motor with increase in the capacity pilot pressure; a capacity pilot line which introduces the pilot oil discharged from the pilot pump to the capacity operation part to provide the capacity pilot pressure to the capacity operation part; a pilot pressure operation valve provided in the capacity pilot line and configured to be opened by input of a capacity instruction to the pilot pressure operation valve at an opening degree corresponding to the capacity instruction to increase the capacity pilot pressure supplied to the capacity operation part through the capacity pilot line; and a capacity instruction input part that inputs the capacity instruction to the pilot pressure operation valve. The capacity pilot line and the pilot pressure control valve make it possible to provide the capacity pilot pressure to the hydraulic pressure supply control part and control it by utilization of the pilot pump included in the brake switching device.

More preferably, the capacity pilot line is connected to the brake releasing line at a position downstream of the brake selector valve. This capacity pilot line allows the supply of the capacity pilot pressure to the capacity operation part to be blocked involved by the switching of the brake selector valve to the braking position to block the supply of the pilot oil to thereby keep the capacity of the slewing motor reliably at the minimum one regardless of the action of the pilot pressure operation valve. In other words, the capacity pilot line is enabled to combine with the brake selector valve of the brake switching device to constitute the capacity limiting unit and allows limiting the capacity and releasing thereof to be conducted reliably in response to the action of the brake selector valve. Besides, the utilization of the brake selector valve in the brake switching device and the capacity pilot line in the capacity control device allow the capacity limiting unit to be formed involving no increase in the number of components.

More specifically, it is preferable that: the capacity operation part of the capacity control device includes a capacity operating cylinder enclosing a piston chamber to which the capacity operation hydraulic pressure is supplied and a capacity operation piston that partitions the piston chamber into a first hydraulic pressure chamber and a second hydraulic pressure chamber and has a shape including a first pressure receiving area facing the first hydraulic pressure chamber and a second pressure receiving area facing the second hydraulic pressure chamber and being larger than the first pressure receiving area, the capacity operation piston being coupled to the slewing motor so as to reduce the capacity of the slewing motor with a displacement of the capacity operation piston in a direction of increasing a volume of the second hydraulic pressure chamber; and the hydraulic pressure supply control part includes a hydraulic pressure supply control valve that is operated, by supply of the capacity pilot pressure to the hydraulic pressure supply control valve, to reduce the capacity operation hydraulic pressure to be supplied to the second hydraulic pressure chamber relatively to the capacity pilot pressure to be supplied to the first hydraulic pressure chamber at a reduction degree corresponding to the capacity operation hydraulic pressure, and configured to make the capacity operation hydraulic pressure to be supplied to the second hydraulic pressure chamber equivalent to the capacity operation hydraulic pressure to be supplied to the first hydraulic pressure chamber to thereby locate the capacity operation piston at a position for minimizing the capacity of the slewing motor, by a difference between the first pressure receiving area facing the first hydraulic pressure chamber and the second pressure receiving area facing the second hydraulic pressure chamber, when no capacity pilot pressure is supplied to the hydraulic pressure supply control valve. This capacity control device allows blocking the supply of the capacity pilot pressure to the hydraulic pressure supply control valve in the braking operating state to cause the capacity of the slewing motor to be kept at the minimum one, by utilization of the difference between respective pressure receiving areas of the capacity operation piston facing the second hydraulic pressure chamber and the first hydraulic pressure chamber in the capacity operation part.

The invention claimed is:

1. A slewing-type working machine comprising:

a base body;

a slewing motor formed of a variable displacement hydraulic motor that is activated to apply a slewing torque for slewing the slewing body to the slewing body by supply of hydraulic fluid to the hydraulic motor;

a capacity control device which controls a capacity of the slewing motor;

a hydraulic pump which discharges hydraulic fluid to be supplied to the slewing motor;

a slewing control device that is operated, by application of a slewing instruction operation for slewing to the slewing control device, to allow hydraulic fluid to be supplied from the hydraulic pump to the slewing motor to activate the slewing motor;

a slewing parking brake switchable between a braking state of applying a stop retention force to the slewing body to retain the slewing body in a stopped state and a brake releasing state of releasing the slewing body to let the slewing body be slewed;

a brake switching device which switches the slewing parking brake between the braking state and the brake releasing state;

a brake release instruction unit which inputs a brake release instruction to the brake switching device to make the brake switching device switch the slewing parking brake from the braking state to the brake releasing state after the slewing control device is operated, by application of the slewing instruction operation to the slewing control device, to allow hydraulic fluid to be supplied from the hydraulic pump to the slewing motor device; and a capacity limiting unit that limits the capacity of the slewing motor which capacity is controlled by the capacity control device, the capacity limiting unit being configured to limit the capacity of the slewing motor controlled by the capacity control device to a predetermined brake-release capacity value or less until a brake release point in time when the slewing parking brake is switched to the brake releasing state in response to the input of the brake release instruction to the brake switching device after the slewing control device is operated, by application of the slewing instruction operation to the slewing control device, to allow hydraulic fluid to be supplied from the hydraulic pump to the slewing motor, and configured to permit the capacity control device to increase the capacity of the slewing motor beyond the brake-release capacity value after the brake release point, wherein the brake-release capacity value is a minimum capacity of the slewing motor.

2. A slewing-type working machine comprising:

a base body;

a slewing motor formed of a variable displacement hydraulic motor that is activated to apply a slewing torque for slewing the slewing body to the slewing body by supply of hydraulic fluid to the hydraulic motor;

a capacity control device which controls a capacity of the slewing motor;

a hydraulic pump which discharges hydraulic fluid to be supplied to the slewing motor;

a slewing control device that is operated, by application of a slewing instruction operation for slewing to the slewing control device, to allow hydraulic fluid to be supplied from the hydraulic pump to the slewing motor to activate the slewing motor;

a slewing parking brake switchable between a braking state of applying a stop retention force to the slewing body to retain the slewing body in a stopped state and a brake releasing state of releasing the slewing body to let the slewing body be slewed;

a brake switching device which switches the slewing parking brake between the braking state and the brake releasing state;

a brake release instruction unit which inputs a brake release instruction to the brake switching device to make the brake switching device switch the slewing parking brake from the braking state to the brake releasing state after the slewing control device is operated, by application of the slewing instruction operation to the slewing control device, to allow hydraulic fluid to be supplied from the hydraulic pump to the slewing motor device; and a capacity limiting unit that limits the capacity of the slewing motor which capacity is controlled by the capacity control device, the capacity limiting unit being configured to limit the capacity of the slewing motor controlled by the capacity control device to a predetermined brake-release capacity value or less until a brake release point in time when the slewing parking brake is switched to the brake releasing state in response to the input of the brake release instruction to the brake switching device after the slewing control device is operated, by application of the slewing instruction operation to the slewing control device, to allow hydraulic fluid to be supplied from the hydraulic pump to the slewing motor, and configured to permit the capacity control device to increase the capacity of the slewing motor beyond the brake-release capacity value after the brake release point, wherein the slewing instruction operation is an operation for designating a slewing speed of the slewing body; the capacity control device is configured to increase the capacity of the slewing motor with increase in the slewing speed designated by the slewing instruction operation; and the capacity limiting unit is configured to limit the capacity of the slewing motor to the brake-release capacity value or less regardless of the slewing speed designated by the slewing instruction operation until the brake release point.

3. A slewing-type working machine comprising:

a base body;

a slewing motor formed of a variable displacement hydraulic motor that is activated to apply a slewing torque for slewing the slewing body to the slewing body by supply of hydraulic fluid to the hydraulic motor;

a capacity control device which controls a capacity of the slewing motor;

a hydraulic pump which discharges hydraulic fluid to be supplied to the slewing motor;

a slewing control device that is operated, by application of a slewing instruction operation for slewing to the slewing control device, to allow hydraulic fluid to be supplied from the hydraulic pump to the slewing motor to activate the slewing motor;

a slewing parking brake switchable between a braking state of applying a stop retention force to the slewing body to retain the slewing body in a stopped state and a brake releasing state of releasing the slewing body to let the slewing body be slewed;

a brake switching device which switches the slewing parking brake between the braking state and the brake releasing state;

a brake release instruction unit which inputs a brake release instruction to the brake switching device to make the brake switching device switch the slewing parking brake from the braking state to the brake releasing state after the slewing control device is operated, by application of the slewing instruction operation to the slewing control device, to allow hydraulic fluid to be supplied from the hydraulic pump to the slewing motor device; and a capacity limiting unit that limits the capacity of the slewing motor which capacity is controlled by the capacity control device, the capacity limiting unit being configured to limit the capacity of the slewing motor controlled by the capacity control device to a predetermined brake-release capacity value or less until a brake release point in time when the slewing parking brake is switched to the brake releasing state in response to the input of the brake release instruction to the brake switching device after the slewing control device is operated, by application of the slewing instruction operation to the slewing control device, to allow hydraulic fluid to be supplied from the hydraulic pump to the slewing motor, and configured to permit the capacity control device to increase the capacity of the slewing motor beyond the brake-release capacity value after the brake release point, wherein the slewing parking brake is a hydraulic negative brake configured to be kept in the braking state when no brake releasing pressure is applied thereto and to be switched to the brake releasing state by supply of the brake releasing pressure thereto; the brake switching device includes a pilot pump which discharges a pilot oil to be supplied to the slewing parking brake through a brake releasing line to generate a brake releasing pressure in the slewing parking brake and a brake selector valve which is provided in the brake releasing line and switchable between a brake releasing position to open the brake releasing line to allow pilot oil to be supplied to the slewing parking brake to thereby switch the slewing parking brake to the brake releasing state and a brake releasing position to close the brake releasing line to thereby hinder pilot oil from being supplied to the slewing parking brake to retain the slewing parking brake in the braking state, the brake selector valve being configured to be switched to the brake releasing position by the brake release instruction input to the brake selector valve; and the capacity control device includes a capacity operation part that is operated by supply of a capacity operation hydraulic pressure to change the capacity of the slewing motor, a hydraulic pressure supply control part that is operated by supply of capacity pilot pressure to change a mode of supply of the capacity operation hydraulic pressure to the capacity operation part so as to increase the capacity of the slewing motor with increase in the capacity pilot pressure, a capacity pilot line which introduces the pilot oil discharged from the pilot pump to the capacity operation part to provide the capacity pilot pressure to the capacity operation part, a pilot pressure operation valve provided in the capacity pilot line and configured to be opened by input of a capacity instruction to the pilot pressure operation valve at an opening degree corresponding to the capacity instruction to increase the capacity pilot pressure supplied to the capacity operation part through the capacity pilot line, and a capacity instruction input part that inputs the capacity instruction to the pilot pressure operation valve.

4. The slewing-type working machine according to claim 3, wherein the capacity pilot line is connected to the brake releasing line at a position downstream of the brake selector valve to thereby combine with the brake selector valve to constitute the capacity limiting unit.

5. The slewing-type working machine according to claim 3, wherein: the capacity operation part of the capacity control device includes a capacity operating cylinder enclosing a piston chamber to which the capacity operation hydraulic pressure is supplied and a capacity operation piston that partitions the piston chamber into a first hydraulic pressure chamber and a second hydraulic pressure chamber and has a shape including a first pressure receiving area facing the first hydraulic pressure chamber and a second pressure receiving area facing the second hydraulic pressure chamber and being larger than the first pressure receiving area, the capacity operation piston being coupled to the slewing motor so as to reduce the capacity of the slewing motor with a displacement of the capacity operation piston in a direction of increasing a volume of the second hydraulic pressure chamber; and the hydraulic pressure supply control part includes a hydraulic pressure supply control valve that is operated, by supply of the capacity pilot pressure to the hydraulic pressure supply control valve, to reduce the capacity operation hydraulic pressure to be supplied to the second hydraulic pressure chamber relatively to the capacity pilot pressure to be supplied to the first hydraulic pressure chamber at a reduction degree corresponding to the capacity operation hydraulic pressure, and configured to make the capacity operation hydraulic pressure to be supplied to the second hydraulic pressure chamber equivalent to the capacity operation hydraulic pressure to be supplied to the first hydraulic pressure chamber to thereby locate the capacity operation piston at a position for minimizing the capacity of the slewing motor, by a difference between the first pressure receiving area facing the first hydraulic pressure chamber and the second pressure receiving area facing the second hydraulic pressure chamber, when no capacity pilot pressure is supplied to the hydraulic pressure supply control valve.

* * * * *